US006213582B1

(12) United States Patent
Uchida et al.

(10) Patent No.: US 6,213,582 B1
(45) **Date of Patent: *Apr. 10, 2001**

(54) INK JET RECORDING APPARATUS AND MECHANISM FOR DISCHARGING MAINTENANCE AND RECOVERY PROVIDED FOR THE APPARATUS

(75) Inventors: Haruo Uchida; Hiroshi Tajika, both of Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/417,266

(22) Filed: Apr. 5, 1995

Related U.S. Application Data

(63) Continuation of application No. 07/975,166, filed on Nov. 12, 1992, now abandoned, which is a continuation of application No. 07/666,616, filed on Mar. 8, 1991, now abandoned.

(30) Foreign Application Priority Data

Mar. 14, 1990 (JP) ..... 2-61214

(51) Int. Cl.[7] ..... B41J 2/165
(52) U.S. Cl. ..... 347/33
(58) Field of Search ..... 347/33, 34

(56) References Cited

U.S. PATENT DOCUMENTS

| | | | | |
|---|---|---|---|---|
| 4,107,699 | * | 8/1978 | Kenworthy | 347/47 |
| 4,112,435 | * | 9/1978 | Kattner et al. | 347/33 |
| 4,313,124 | | 1/1982 | Hara | 347/57 |
| 4,340,897 | * | 7/1982 | Miller | 347/33 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/65 |
| 4,723,129 | | 2/1988 | Endo et al. | 347/56 |
| 4,740,796 | | 4/1988 | Endo et al. | 347/56 |
| 4,847,637 | * | 7/1989 | Watanabe et al. | 347/30 |
| 4,935,753 | * | 6/1990 | Lehmann et al. | 347/33 |
| 4,951,066 | * | 8/1990 | Terasawa et al. | 347/33 |
| 5,182,582 | * | 1/1993 | Okamura | 347/33 |

FOREIGN PATENT DOCUMENTS

| | | |
|---|---|---|
| 3726671 | 7/1988 | (DE) . |
| 130805 | 1/1985 | (EP) . |
| 313204 | 4/1989 | (EP) . |
| 323261 | 7/1989 | (EP) . |
| 0398348 | 1/1990 | (EP) . |

(List continued on next page.)

*Primary Examiner*—John Barlow
*Assistant Examiner*—Michael Brooke
(74) *Attorney, Agent, or Firm*—Fitzpatrick, Cella, Harper & Scinto

(57) ABSTRACT

An ink jet recording apparatus comprises an ink jet recording head for discharging ink onto a recording medium, with the recording head including a first surface defining at least one discharge port and a second surface surrounding the first surface, and a carriage for movably supporting and mounting the recording device. A cleaning device cleans the ink jet recording head and is formed of an elastic plate-like member having a first cleaning member for primarily cleaning the first surface and a second cleaning member for primarily cleaning the second surface. A displacing mechanism displaces the cleaning device between a cleaning position at which the cleaning device cleans the ink jet recording head and a non-cleaning position at which the cleaning device is remote from the ink jet recording head. The cleaning device is formed such that the first cleaning member contacts the ink jet recording head before the second cleaning member during relative movement between the cleaning device and the ink jet recording head in a cleaning direction.

44 Claims, 14 Drawing Sheets

FOREIGN PATENT DOCUMENTS

| | | | | |
|---|---|---|---|---|
| 2085807 | | 5/1982 | (GB) . | |
| 54-56847 | | 5/1979 | (JP) . | |
| 94472 | * | 6/1983 | (JP) | 347/33 |
| 45163 | * | 3/1984 | (JP) | 347/33 |
| 59-123670 | | 7/1984 | (JP) . | |
| 59-138461 | | 8/1984 | (JP) . | |
| 60-71260 | | 4/1985 | (JP) . | |
| 0101447 | * | 10/1985 | (JP) . | |
| 62-101448 | | 5/1987 | (JP) | B41J/3/04 |
| 113558 | * | 5/1987 | (JP) | 347/33 |
| 62-101447 | * | 5/1987 | (JP) | 347/33 |
| 275047 | * | 11/1989 | (JP) | 347/33 |
| 275049 | * | 11/1989 | (JP) | 347/33 |

* cited by examiner

INK JET RECORDING APPARATUS AND MECHANISM FOR DISCHARGING MAINTENANCE AND RECOVERY PROVIDED FOR THE APPARATUS

This application is a continuation of application Ser. No. 07/975,166 filed Nov. 12, 1992, now abandoned, which in turn is a continuation of application Ser. No. 07/666,616 filed Mar. 8, 1991, now abandoned.

BACKGROUND OF THE INVENTION

1. Field of the Invention

The present invention relates to an ink jet recording apparatus to form a desired image by discharging ink and a mechanism for discharging maintenance and recovery employed to maintain and recover the discharging condition of recording means of discharging ink for the recording apparatus.

2. Related Background Art

In an ink jet recording apparatus, there is a phenomenon observed when the ink mist generated by a recording performance adheres to the discharging port formation face of the recording head or that dirt and dust in the apparatus or foreign substances such as paper particles, etc. concomitantly produced when transporting a recording medium, adhere to the discharging port formation face. Such adherence of foreign substances to the discharging port formation face results in shifting the emitting direction of ink in some cases or clogging the discharging ports in the worst case. This leads to the deterioration of the ink discharging condition such as clogging, etc. and lowers the quality of the recorded image. For the purpose of improving such condition causing the deterioration of image quality, there has been proposed an apparatus wherein a cleaning member is arranged at a position in the non-recording region of a recording area opposite to the discharging port formation face to remove the adherent ink and foreign substances by slidably rubbing the discharging port formation face with a blade made of silicone rubber, etc., for example. Also, there has been proposed an apparatus provided with means for recovery by suction to forcibly exhaust ink from the discharging ports by generating a given suction force on the discharging port formation face by use of a pump while forming a closed system in the ink discharging unit using a capping member as a method of recovering from the clogging condition caused by the increased viscosity of ink resulting from ink dehydration at the discharging ports, clogging brought about by ink sticking or bubbles and dust produced in the liquid path. Nevertheless, if this suction recovery is performed, there occurs a state where ink remains in the contacting portion between the discharging port formation face and the capping member. (Hereinafter ink thus remaining is referred to as "cap marking ink"). Therefore, the structure is so arranged that this cap marking ink can also be cleaned off together with the ink mist and foreign substances by rubbing the discharging port formation face with the aforesaid cleaning member.

For example, as shown in FIG. 1, there has been proposed an apparatus wherein a cleaning member comprising a plastic board is arranged at the side of a capping member between the home position of a recording head and the recording area to clean the discharging port formation face of the recording head. Also, as shown in FIG. 2, there has been proposed an apparatus wherein a cleaning member comprising two cleaning members mounted in parallel thereon is arranged, each member having a different cleaning characteristic such as different hardness or different amount of contacting depth, which generates different contact pressure against the discharging port formation face.

From the viewpoint of a simpler manufacturing process and lower manufacturing cost, recording heads having a discharging port formation face which is not flat have been proposed in recent years.

The discharging port formation face which is not flat makes it impossible for the cleaning members constructed as shown in FIG. 1 and FIG. 2 to clean the vicinity of the discharging ports sufficiently in some cases. For example, as shown in FIG. 3 and FIG. 4, while recording head 21 is structured in such a manner that a front plate is arranged in the circumference of discharging ports 21*a* to constitute the discharging port formation face, the portion of discharging ports 21*a* forms a concavity which is sunken from the plane of the cap contacting portion 21*b*. In the aforesaid portion of discharging ports 21*a*, ink droplets (including foreign substances) $Y_2$ remain, and on the aforesaid cap contacting portion 21*b*, cap marking ink $Z_2$ remain. In this condition, when recording head 21 is transported in the direction indicated by arrow A to be in contact with rubber blade 22, the cleaning of the discharging port formation face is performed.

As shown in FIG. 4, however, whereas cap marking ink $Z_2$ is cleaned off by rubber blade 22 as recording head 21 is being transported in the direction indicated by arrow A in this example, ink droplets (including foreign substances) $Y_2$ in the portion of discharging ports 21*a* remain uncleaned because these are not in contact with rubber blade 22 due to the concavity formed in the portion of discharging ports 21*a*.

As the above describes, in the case where the recording head is structured with a step presenting the different planes for the region in which the discharging ports are formed and the regions other than that region, it is difficult to perform a complete cleaning over the entire region of the discharging port formation face.

SUMMARY OF THE INVENTION

In consideration of a condition such as this, the present invention is designed and an object thereof is to provide a mechanism for discharging maintenance and recovery to maintain an excellent condition of ink discharging from an ink jet recording head, which performs an extremely effective cleaning with a one-time cleaning operation even if the discharging port formation face of the recording head is not formed on the same plane as the other portions thereof as well as an ink jet recording apparatus provided with the aforesaid mechanism.

Another object of the present invention is to provide an ink jet apparatus which comprises:

- a carriage member for mounting recording means for discharging ink;
- a cleaning member arranged to face regions other than the recording region of the recording means for cleaning a discharging port formation face of the recording means;
- transporting means for transporting the cleaning member to the position to clean the recording means and to the position not to clean it;
- driving means for relatively driving the carriage member and the transporting means for the cleaning member to clean the discharging port formation face; and
- the cleaning member being provided with a first cleaning member mainly used for cleaning the discharge port formation portion of the recording means and a second cleaning member mainly used for cleaning the circumference of the aforesaid discharging port formation portion.

Still another object of the present invention is to provide an ink jet apparatus which comprises:

a carriage member for mounting the recording means which is structured to form a concave ink discharging port formation portion;

a capping member used to cover the discharging port formation face of the recording means for the maintenance and recovery of the ink discharging condition;

a cleaning member arranged to face regions other than the recording region of the recording means for cleaning the discharging port formation face of the recording means;

a driving means for relatively driving the carriage member and the cleaning member to clean the discharging port formation face; and the cleaning member being provided with a first cleaning member mainly used for cleaning the concavity of the recording means and a second cleaning member mainly used for cleaning circumferential regions around the concavity.

A further object of the present invention is to provide a mechanism for the discharging maintenance and recovery to maintain and recover the ink discharging condition by slidably rubbing the discharging port formation face of the recording means, which is provided with a first cleaning member mainly used for cleaning a concave of the recording means and a second cleaning member mainly used for cleaning circumferential regions around the concave portion.

The second cleaning member arranged independently of the first member also clean completely the portions to which the liquid droplets adhere other than the portion to be cleaned by the first cleaning member, thereby making it possible to perform a perfect cleaning irrespective of whether the discharging ports of the recording head are formed on the same plane of the other portions thereof or not.

DESCRIPTION OF THE PREFERRED EMBODIMENTS

Hereinafter, in reference to the accompanying drawings, the embodiments of the present invention will be described.

Figure 1:
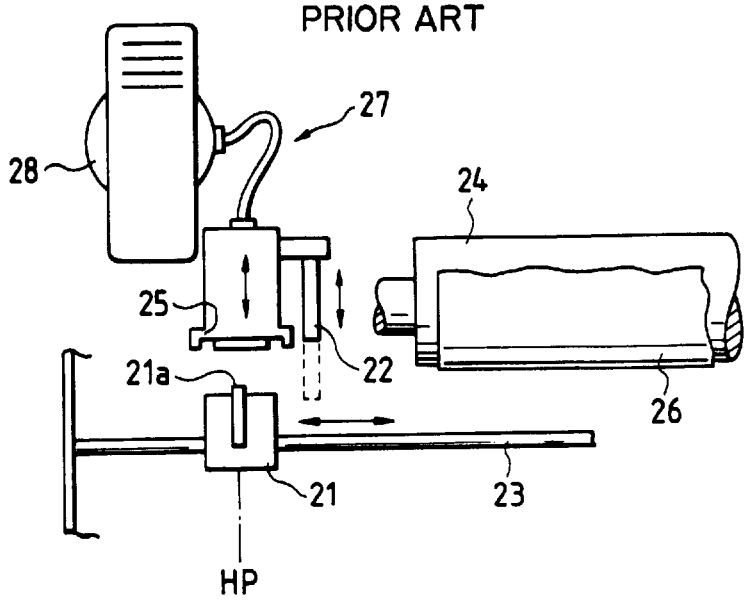
FIG. 1 PRIOR ART
FIG. 1 is a schematic view systematically showing one form of a cleaning blade.
Figure 2:
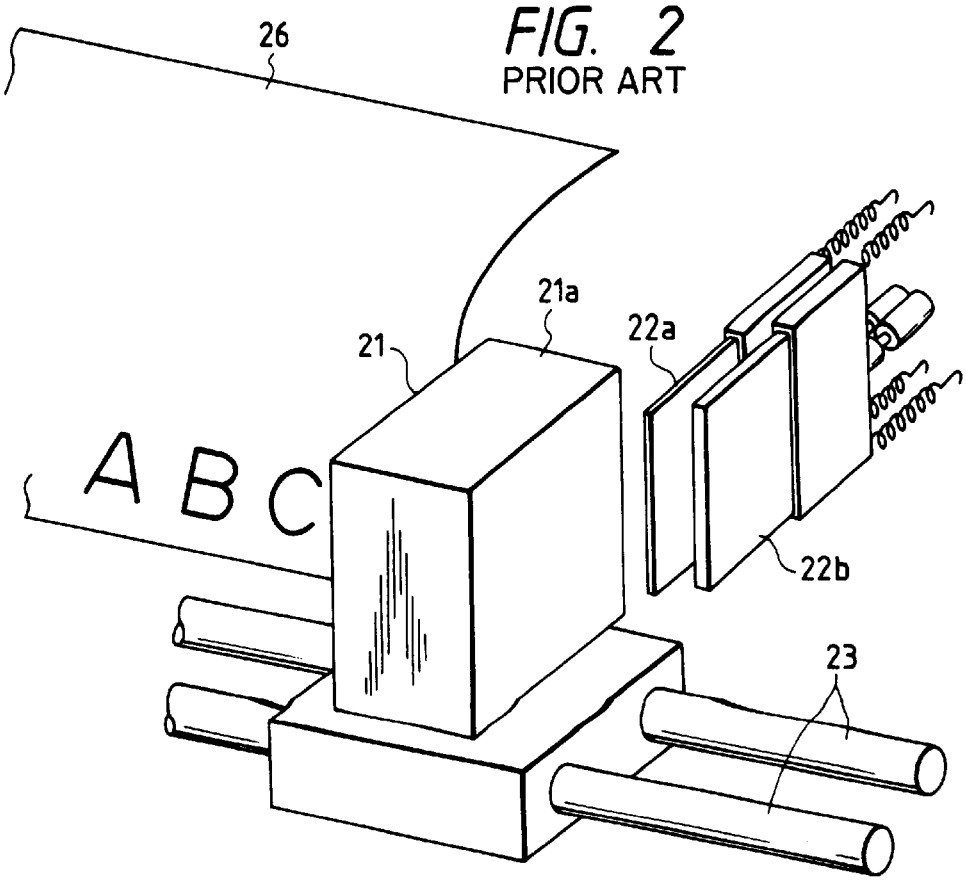
FIG. 2 PRIOR ART
FIG. 2 is a schematic view systematically showing another form of a cleaning blade.
Figure 3:
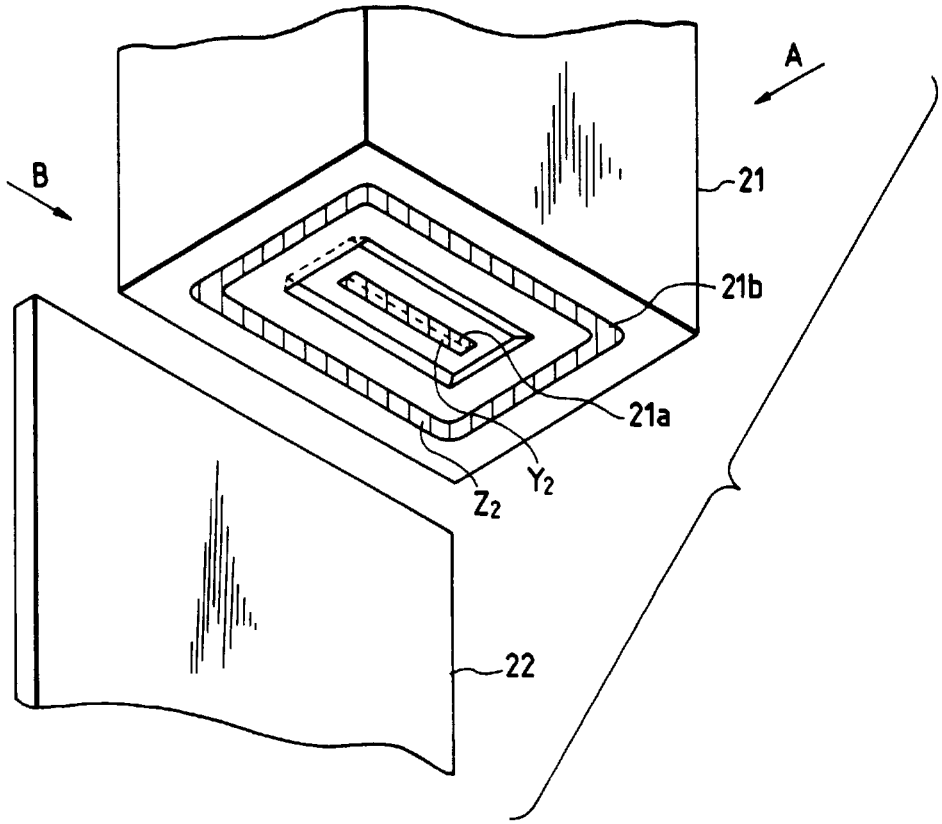
FIG. 3 PRIOR ART
FIG. 3 is a perspective view showing still another example of the cleaning member of an ink jet recording apparatus.
Figure 4:
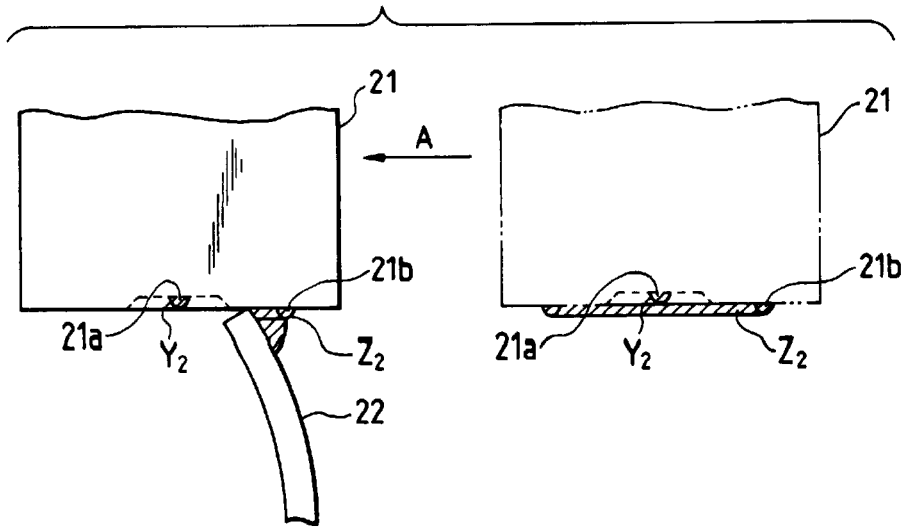
FIG. 4 PRIOR ART
FIG. 4 is a view illustrating the movement of still another example shown in FIG. 3 observed in the direction indicated by arrow B.
Figure 5:
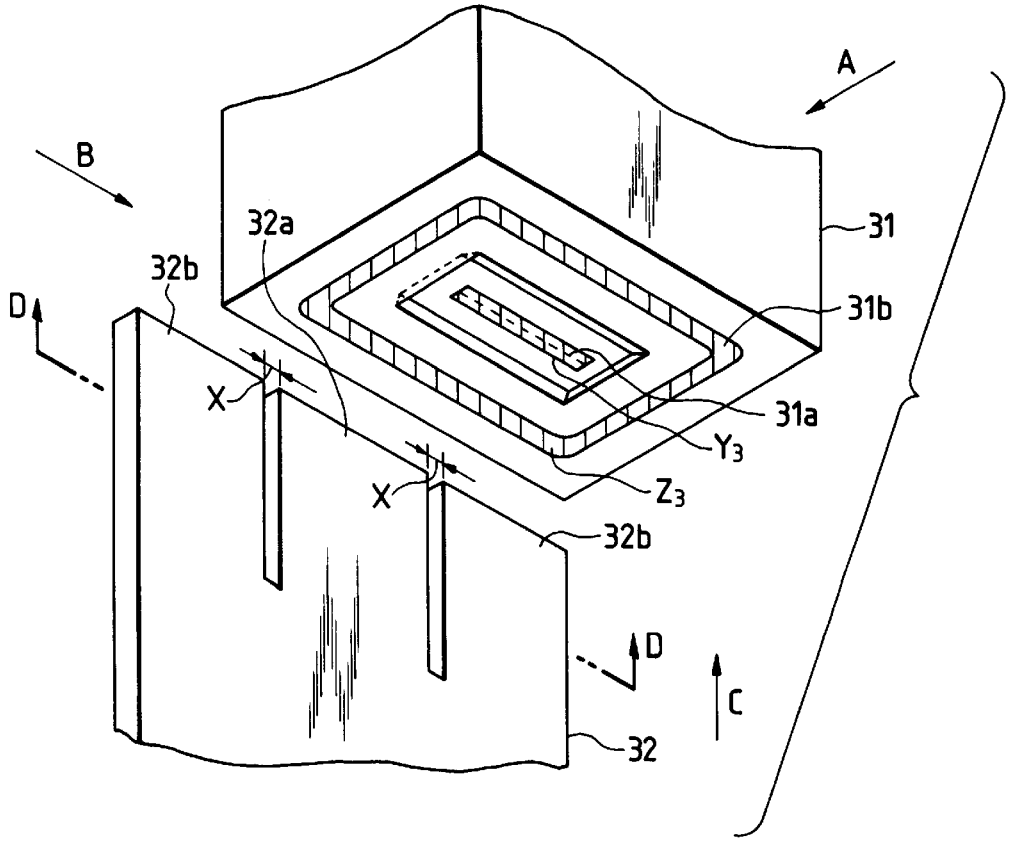
FIG. 5 is a perspective view schematically showing an embodiment of cleaning member of an ink jet recording apparatus according to the present invention.
Figure 6:
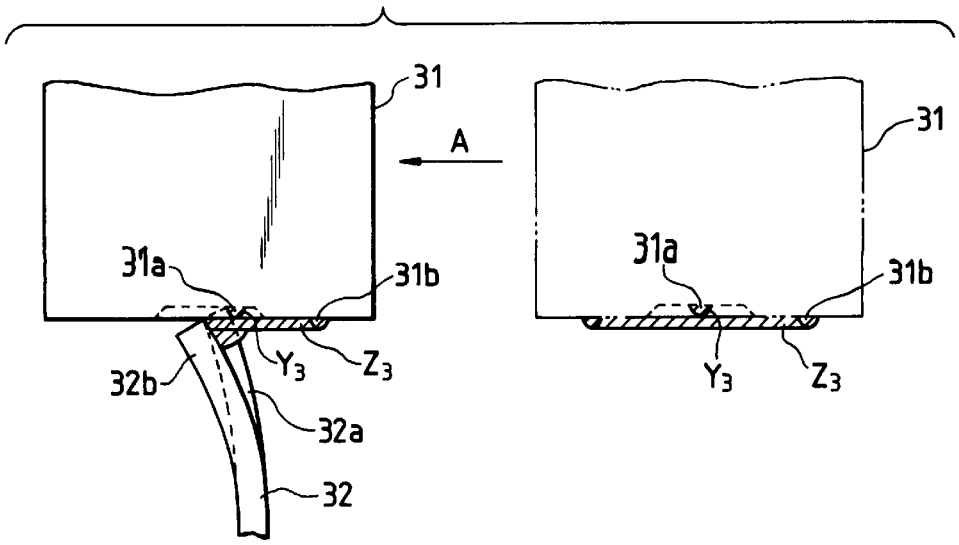
FIG. 6 is a view of the cleaning member shown in FIG. 5 observed in the direction indicated by arrow B.
Figure 7:
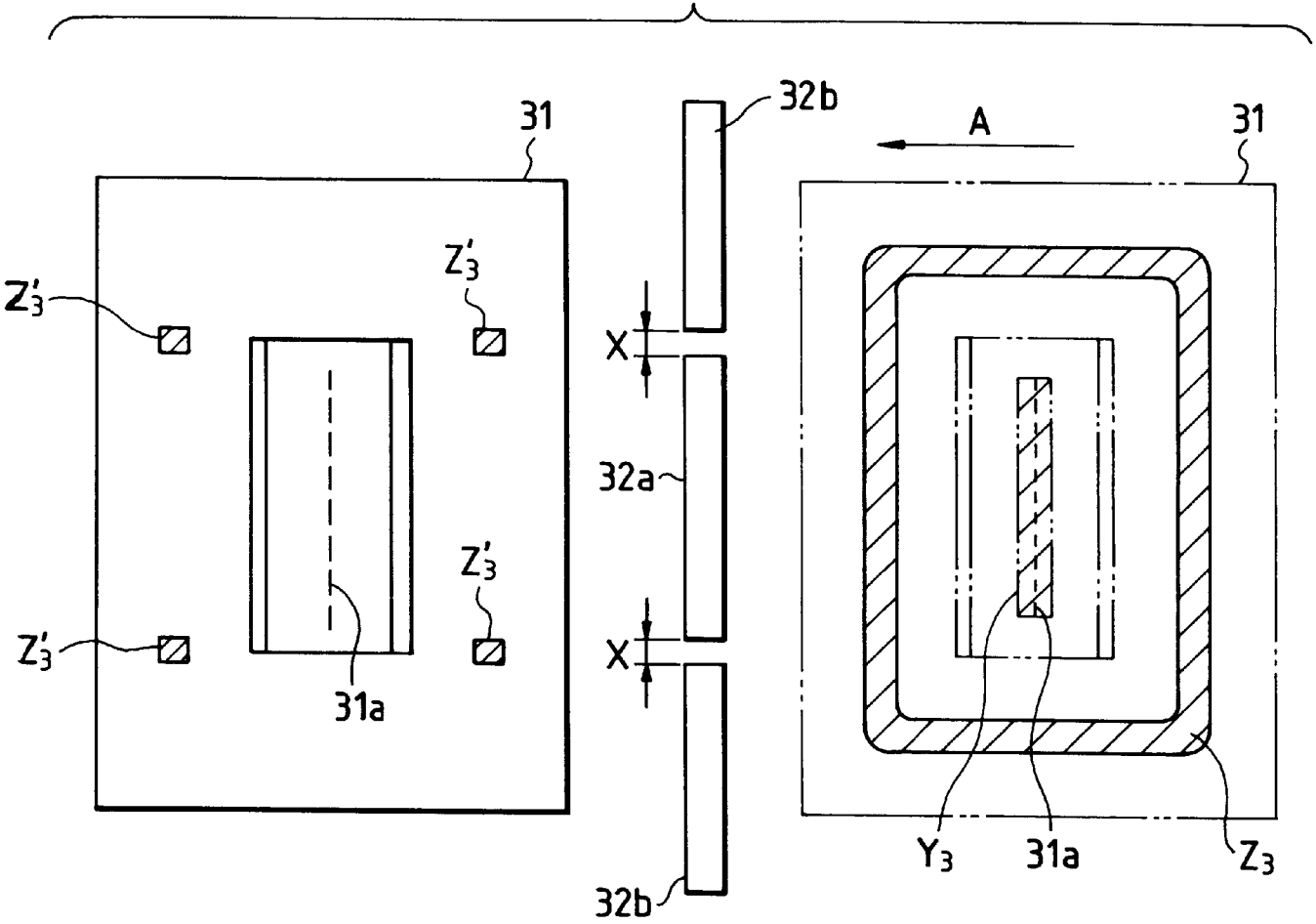
FIG. 7 is a view of the cleaning member shown in FIG. 5 observed in the direction indicated by arrow C.

A first embodiment according to the present invention is shown in FIG. 5 through FIG. 7. As shown in FIG. 5, cleaning blade 32 for cleaning the discharging port formation face of the ink jet recording apparatus is provided with two slits on the side of the rubber blade 32, at which the blade is in contact with the recording head 31. These slits divide the blade into a member 32*a* to clean the discharging port portion and members 32*b* to clean the circumferential portions, particularly the cap marking ink remaining thereon. With rubber blade 32 thus formed, ink droplets $Y_3$ in the discharging port portion 31*a* of recording head 31 is rubbed off by sliding blade 32*a* for cleaning as shown in FIG. 6 while cap marking ink $Z_3$ is also rubbed off by sliding blade 32*b* for cleaning. As a result, excellent cleanings are performed by the application of these functions enabled to demonstrate the respective capabilities sufficiently in this fashion.

As shown in FIG. 7, ink droplets and foreign substances $Y_3$ adhering to discharging ports 31*a* are cleaned off excellently by cleaning blade 32 structured as in the present embodiment. However, the cap marking ink $Z_3'$ remaining in the portion corresponding to gap X of each slit of the divided rubber blades 32*a* and 32*b* can not be cleaned off sufficiently because the ink in that particular portion escapes from the slidable rubbing of the blade and remains unwiped. This situation can be corrected by making the aforesaid gap X narrower, but it is not desirable to make the gap X sufficiently narrow because if the gap X is made too narrow, then the divided rubber blades 32*a* and 32*b* adversely affect each other in the cleaning operation.

Figure 8:
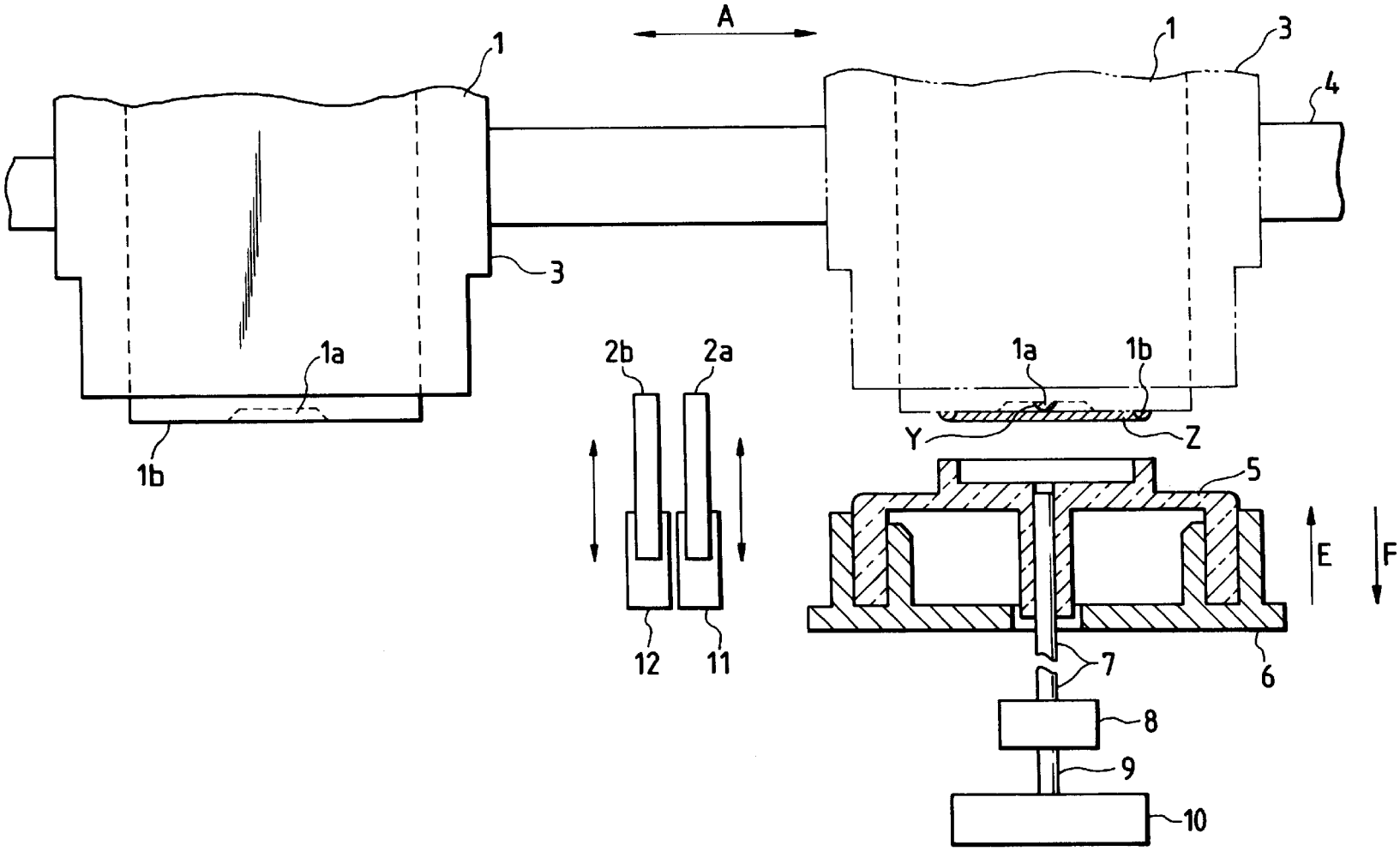
FIG. 8 is a partially cross-sectional view illustrating the principal part of another embodiment according to the present invention.

Therefore, as shown in FIG. 8 through FIG. 11, the structure is so arranged as a second embodiment that the cap marking ink can be better cleaned. FIG. 8 is a view of the present embodiment observed from the front, in which recording head 1 is installed on main scanning carriage 3 movably mounted on main scanning rail 4 to be shuttled in the directions indicated by arrow A. The aforesaid recording head 1 discharges ink from discharging ports 1*a* by utilizing heat energy with an electrothermal converter (not shown) provided therein as means for generating the heat energy.

Then, recording head 1 provides cap contacting portion 1*b* where rubber cap 5, which will be described later, is in contact with the recording head. The portion where the aforesaid discharging ports 1*a* are arranged is formed to show a concavity which is sunken from the aforesaid cap contacting portion 1*b*. To the portion where the aforesaid discharging ports 1*a* are arranged, ink mist generated by recording, paper particles produced by recording medium, dirt and dust in the apparatus, etc. Y adhere, and to the cap contacting portion 1*b* where the cap used for the protection and recovery of the recording head is in contact with the recording head, cap marking ink Z adheres by the suction recovery process, for example.

Here, rubber cap 5 forms a closed system in cooperation with the aforesaid recording head 1 to prevent water evaporation from discharging ports 1*a* or to protect the discharging port formation face by closely contacting with recording head 1 when the recording is not in operation, or to perform the maintenance, recovery, etc. of the discharging condition. The aforesaid rubber cap 5 is supported by cap holder 6 which is movable by driving means (not shown) in the directions indicated by arrows E and F. Suction pump 8 generates a given suction force in the closed system formed by the aforesaid rubber cap 5 and recording head 1 to perform the suction recovery by sucking ink forcibly from discharging ports 1*a* through the first tube 7, which causes ink to be sucked and exhausted from discharging ports 1*a* and by exhausting the sucked ink to waste ink disposing member 10 through the second tube 9.

In the vicinity of recording head 1, there are arranged one piece of first cleaning member 2*a* supported by first holder 11 and two pieces of second cleaning member 2*b* (in FIG. 8, only one piece is represented) supported by second holder 12. First cleaning member 2*a* and second cleaning member 2*b* are both resilient plate members made of, for example, silicon rubber or porous spongy material to form blades, which are structured to be movable by driving means (not shown) through first holder 11 and second holder 12 respectively. These members are moved to a position to rub against discharging ports 1*a* of recording head 1 and cap contacting portion 1*b* at the time of cleaning and moved to a retracted position at the time of recording.

Figure 9:
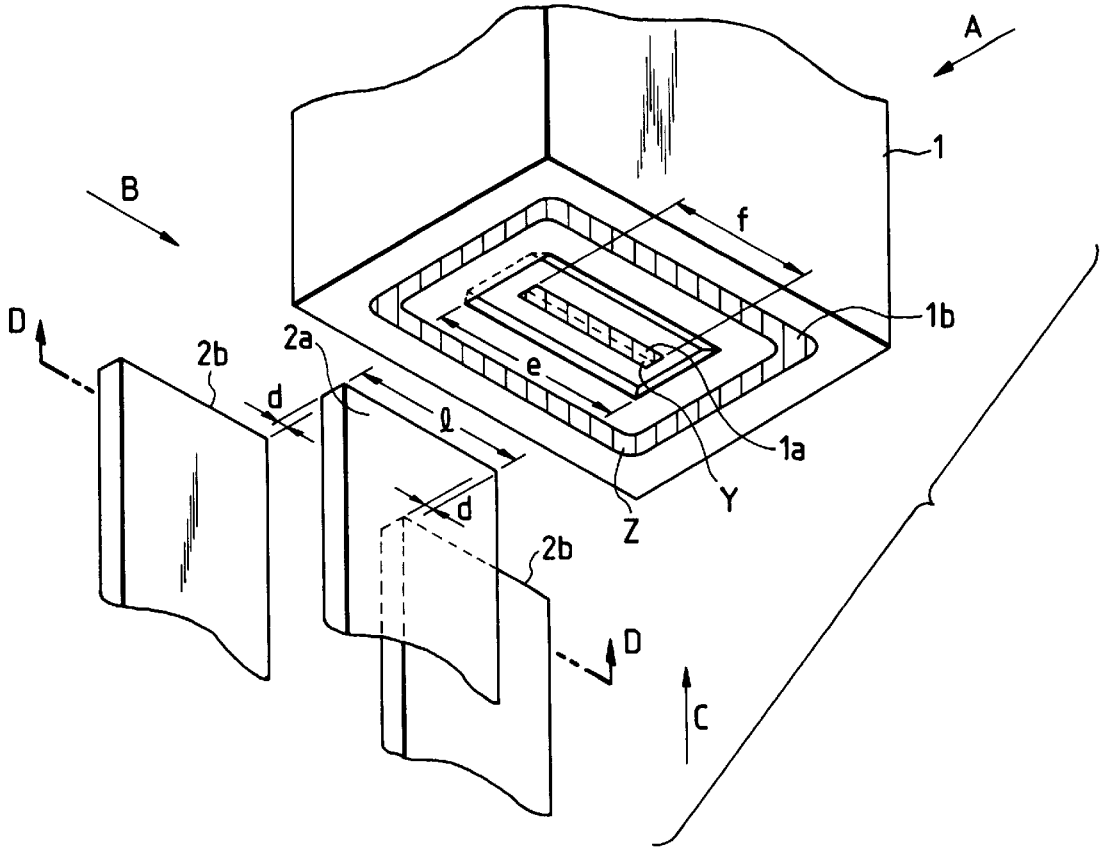
FIG. 9 is a perspective view showing the principal part thereof.

Also, as shown in FIG. 9, the size of first cleaning member 2*a* is defined to provide its width l wider than the width f of discharging ports 1*a* but narrower than the width e of the concave portion of the aforesaid discharging ports 1*a* so as to clean the ink droplets off of the discharging ports 1*a* as well as the portion of cap marking ink Z equivalent to the width of first cleaning member 2*a* itself. Meanwhile, the two pieces of cleaning member 2*b* are arranged to provide the portion corresponding to the width d of the region to rub off for cleaning in such a manner that such portion is overlapped with the region to be rubbed off for cleaning by first cleaning member 2*a;* thus leaving no ink uncleaned. The two pieces of second cleaning member 2*b* also clean the portions of the adherent ink remaining on the discharging port formation face of recording head 1*a* other than the portion cleaned off by first cleaning member 2*a*.

Subsequently, the cleaning process in the present embodiment will be described.

Figure 10:
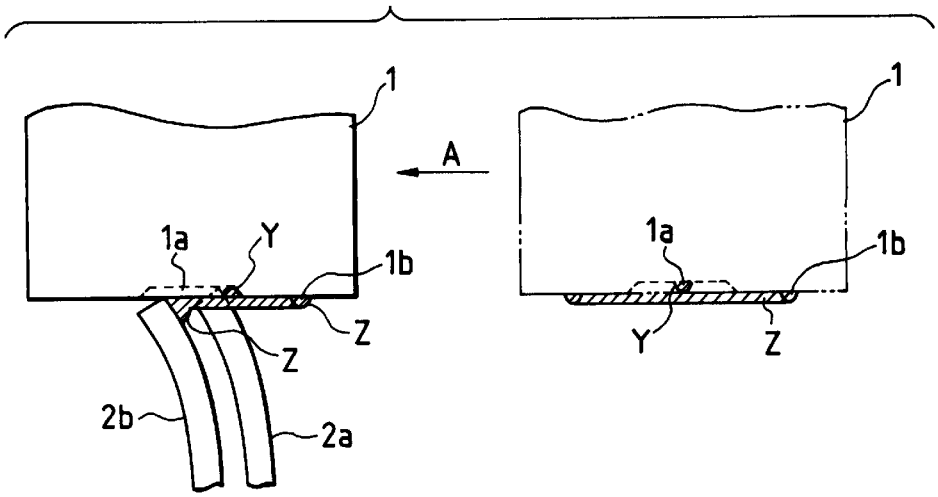
FIG. 10 is a view illustrating the movement of another embodiment shown in FIG. 8 observed in the direction indicated by arrow B.
Figure 11:
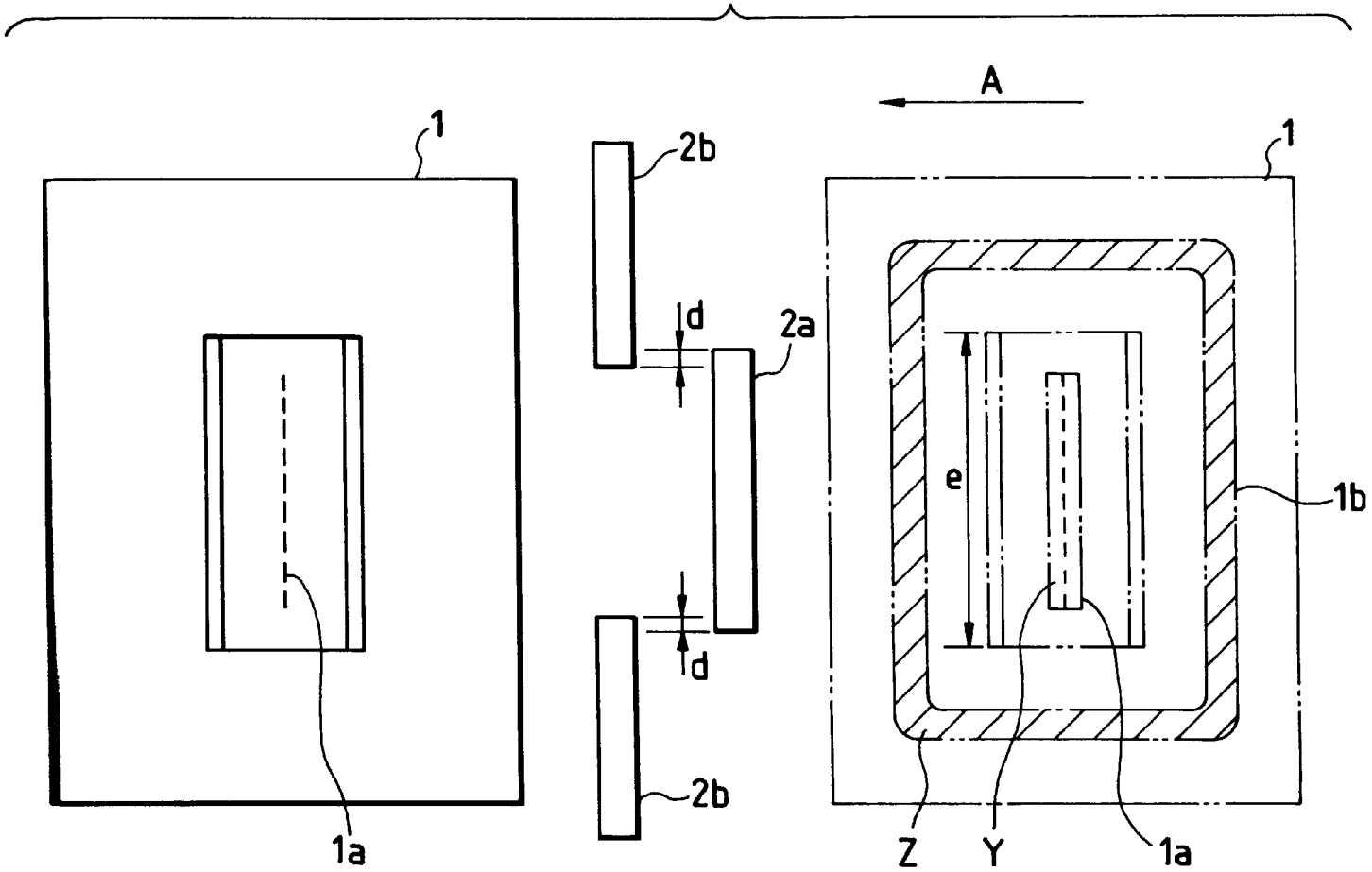
FIG. 11 is a view illustrating the movement of another embodiment shown in FIG. 9 observed in the direction indicated by arrow C.

As shown in FIG. 10 and FIG. 11, ink droplets Y adhere to the portion of discharging ports 1*a* while cap marking ink Z adheres to cap contacting portion 1*b*. In this condition, when recording head 1 is moved in the direction indicated by arrow A, ink droplets Y are cleaned off by first cleaning member 2*a* and cap marking ink Z is cleaned off by second cleaning members 2*b* as shown in FIG. 10 and FIG. 11. First cleaning member 2*a* and second cleaning members 2*b* overlap with each other in the width portions d, thus making it possible to remove ink droplets Y and cap marking ink Z perfectly from the discharging port formation face of recording head 1.

Figure 12:
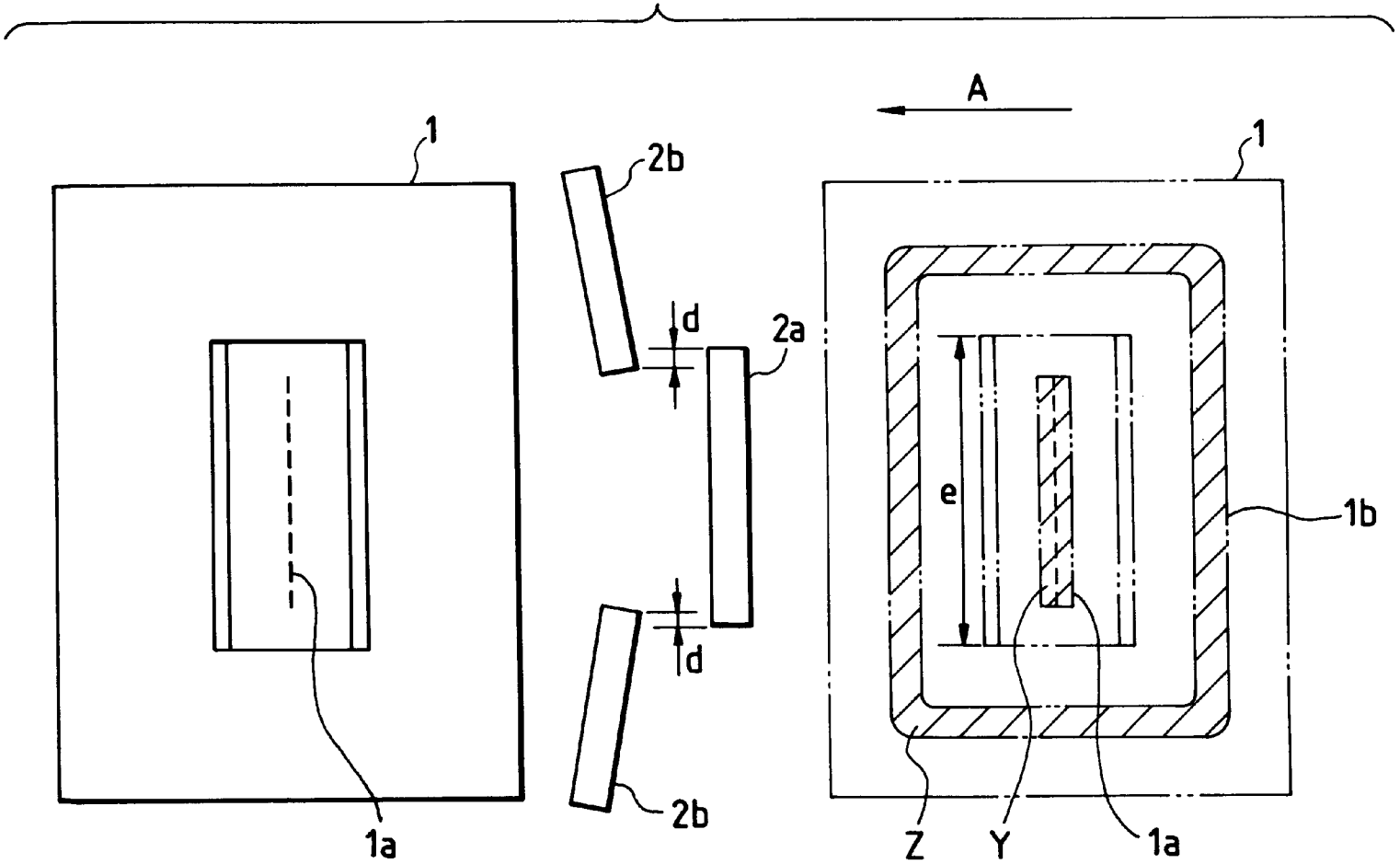
FIG. 12 is a view schematically showing a variation of another embodiment shown in FIG. 8.

In this respect, the structure of cleaning members shown in FIG. 8 through FIG. 11, particularly that of second cleaning members 2*b* for cleaning cap marking ink Z, may be arranged to form a shape of almost as shown in FIG. 12 in which the members angle themselves towards the outside.

With a structure such as this, cap marking ink Z tends to run outwards when the ink Z is being cleaned off; it is thus possible to remove cap marking ink Z more assuredly to make the influence against the discharging ports extremely small.

Figure 13:
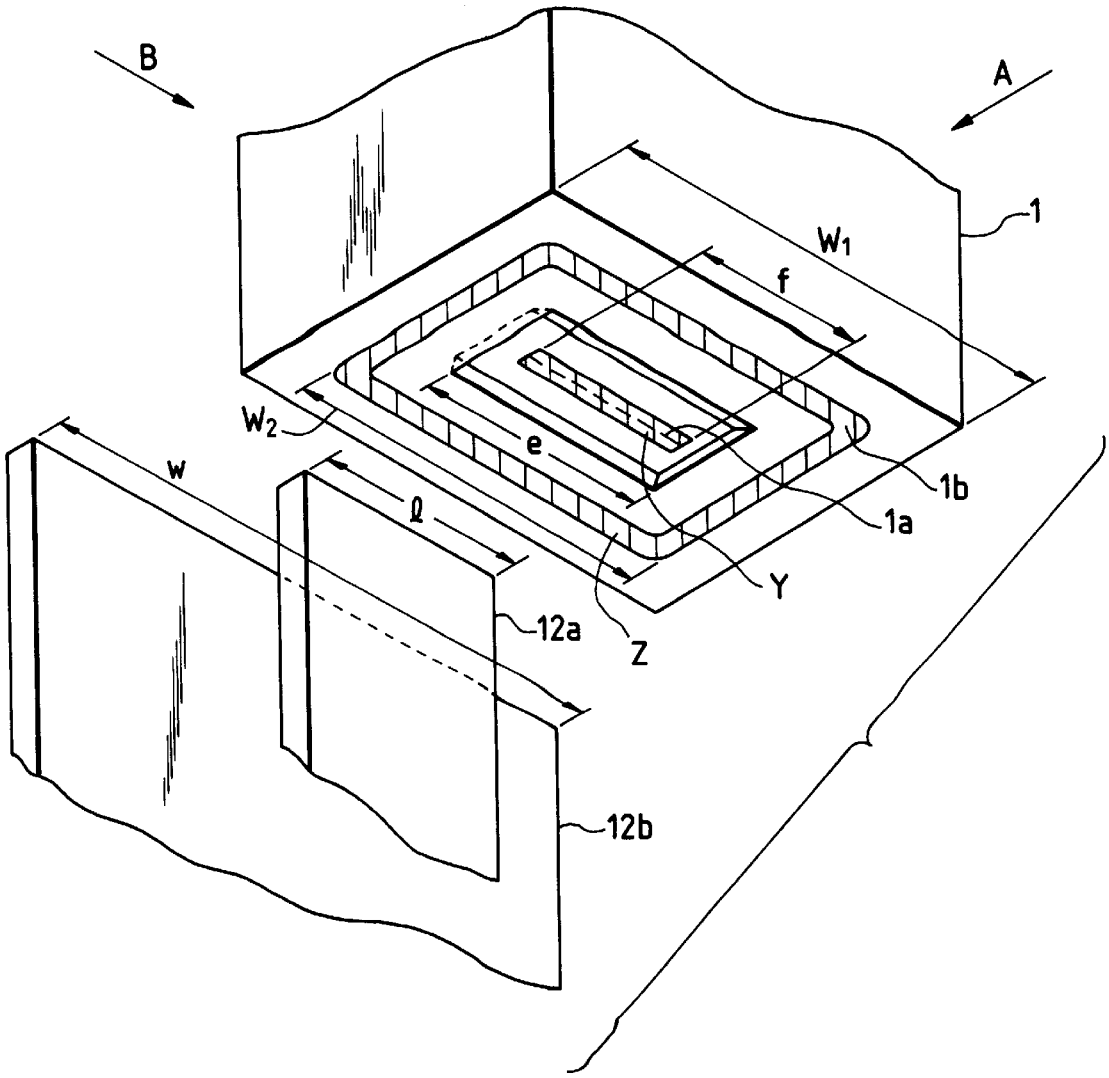
FIG. 13 is a perspective view showing the principal part of still another embodiment according to the present invention.

FIG. 13 illustrates a third embodiment according to the present invention. In the embodiments shown in FIG. 8 through FIG. 12, second cleaning member 2*b* comprises two separate pieces. In the present embodiment, however, second cleaning member 12*b* comprises one piece. If only its width is sufficiently wide, it is still possible to clean cap marking ink Z perfectly even with the second cleaning member 12*b* comprising only one piece as mentioned above. Ink droplets Y on discharging ports 1*a* are cleaned off completely by first cleaning member 2*a* as in the first embodiment.

Regarding the cleaning members according to the present embodiment, it is desirable for first cleaning member 1*a* to maintain a relationship that the width l of the first cleaning member 1*a* is longer than the alignment width f of the ink discharging ports and shorter than the width e of the concavity, i.e., $f<l<e$. By satisfying this relationship, it becomes possible to attain an excellent cleaning of ink droplets and foreign substances remaining on the discharging port portion.

Also, the width w of second cleaning member 12*b* must be wider than the width $w_2$ of cap marking ink Z because it is necessary to clean off cap marking ink Z assuredly. In this respect, although the width w of second cleaning member may be wider or narrower than the width $W_1$ of the head, if the structure thereof is arranged to satisfy a condition, $W_1 \geqq w$, it is possible to attain the maximum cleaning effect while implementing the reduction of space required for mounting the cleaning member.

Here, in the present embodiment, these first and second cleaning members are formed by the same material having the same thickness. However, in consideration of cleaning characteristics, it is desirable to decide on the materials, thicknesses, etc. of the members accordingly. The cleaning members in each of the aforesaid embodiments are formed by urethane rubber or hydrogenated nitrical butadiene rubber, and the thickness thereof is approximately 0.7 mm.

In this respect, since the contacting area of the second cleaning member with the head is quite wide, there are some cases where a satisfactory cleaning effect cannot necessarily be obtained if the material and thickness thereof are the same as those of the first cleaning member.

For example, in practice it is only the second cleaning member and the cap contacting region of the head which are in contact in the case of cleaning the front face including the region of discharging port formation face, whereas a force is being exerted almost in the central part of the cleaning member due to its resiliency to restore itself from deformation at the time of cleaning. Then, because of this, the central part of the second cleaning member is bent to show a convexity. In this case, if the curvature is great, this member is in contact with the discharging port formation face and there is a possibility that ink is caused to adhere again to the portion which has been cleaned by the first cleaning member.

Therefore, the thickness of the second cleaning member might be thicker. Then, there occurs another possibility that the resilient deformation force becomes completely different if the thickness of the entire body of the member is made thicker; thus causing the finish of the head surface to be detriorated or leading to the generation of defective cleaning characteristics. In order to correct this situation, it is desirable to form the cleaning member in such a way that in the vicinity of its contacting portion with the head, cladding is applied to thicken the portion thereof to slidably rub the head for cleaning, thereby preventing the curring deformation of the second cleaning member in cleaning the discharging port portion.

With this structure, it is possible to attain an excellent cleaning because the bending of the second cleaning member can be prevented in cleaning the cap contacting portion corresponding to the region of the discharging ports without any change in the contacting condition between the head and the second cleaning member, and there is no possibility of the aforesaid problem to arise.

Figure 14:
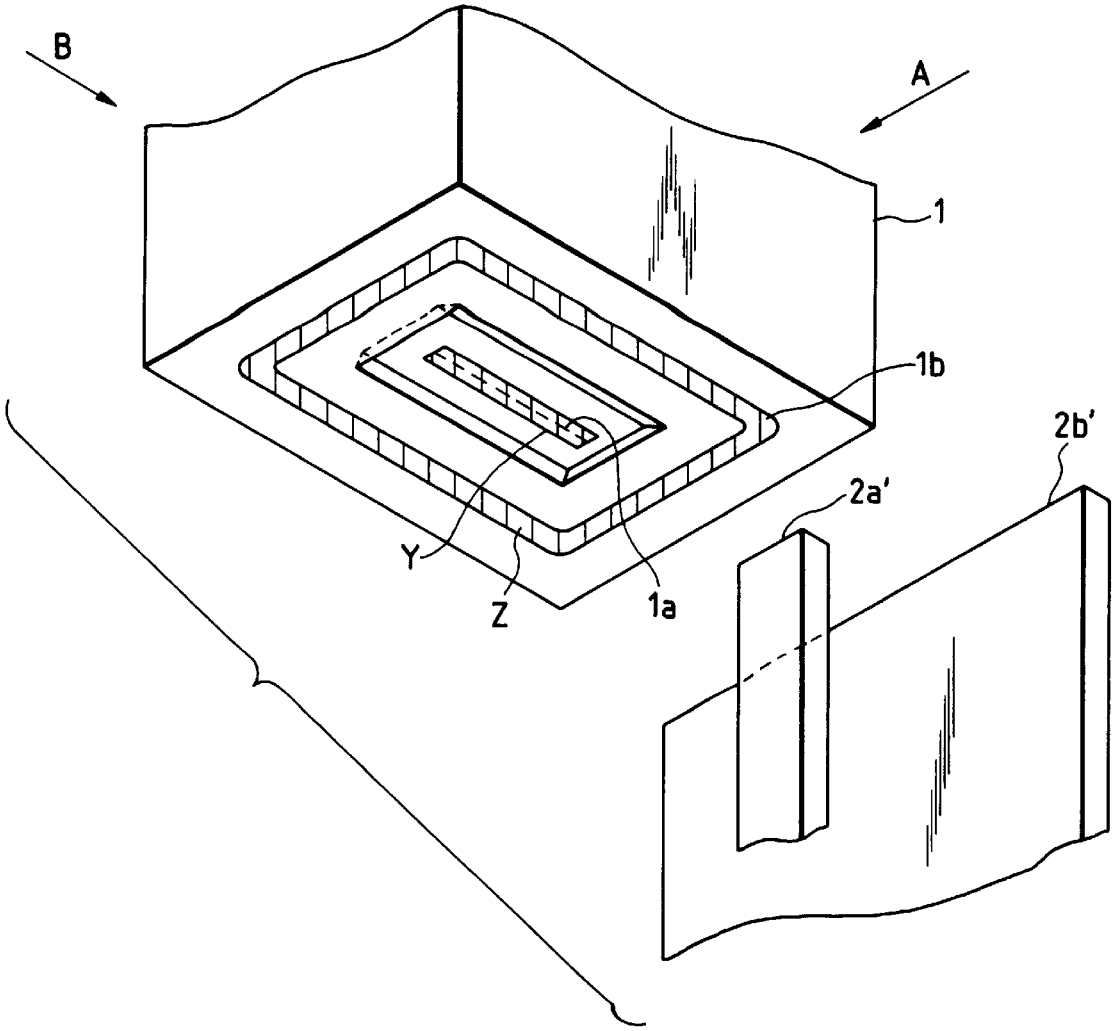
FIG. 14 is a perspective view showing the principal part of a further embodiment according to the present invention.
Figure 15:
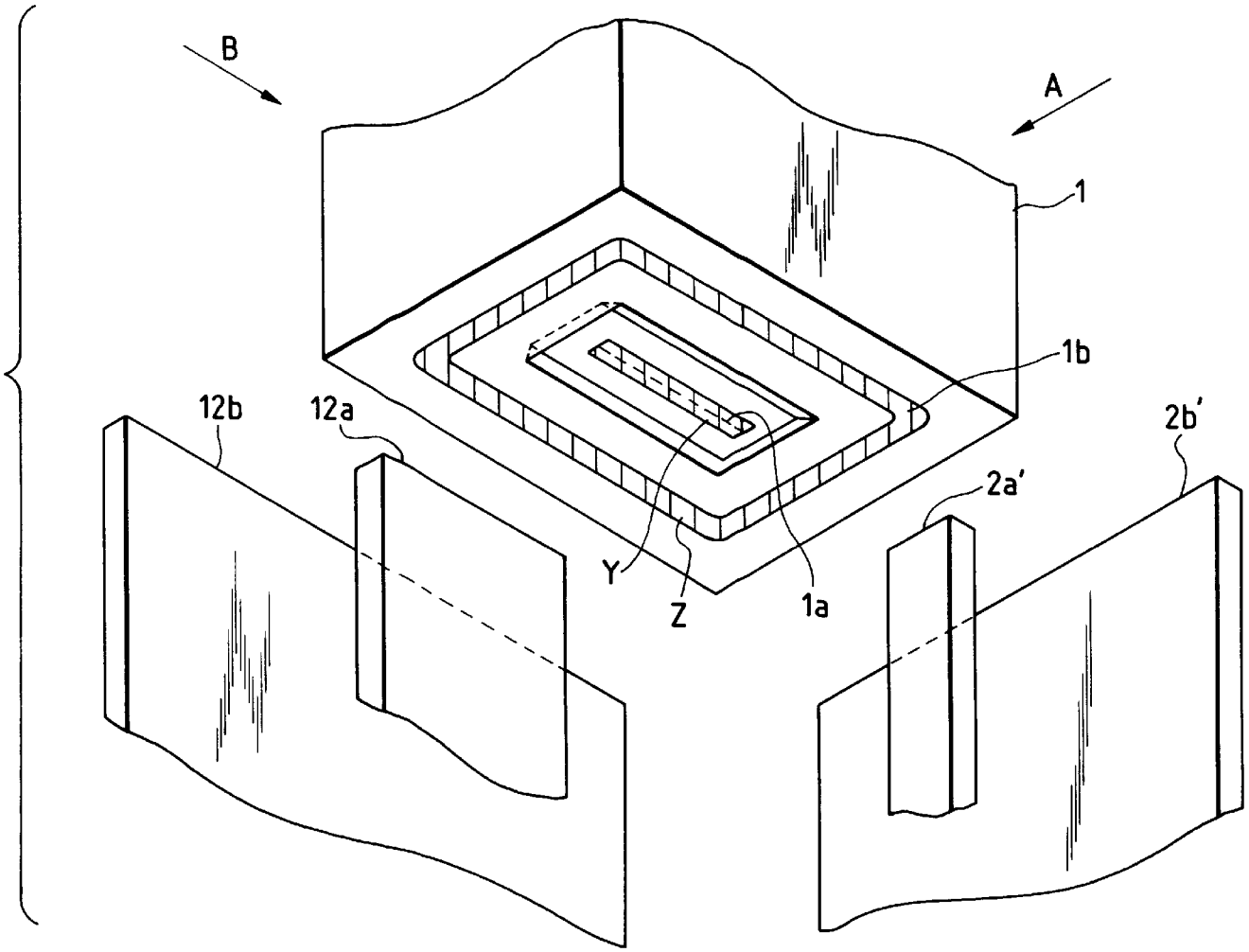
FIG. 15 is a perspective view showing the principal part of still a further embodiment according to the present invention.

Also, the direction of the slidable rubbing for cleaning can be varied (vertical direction) from the direction in which each cleaning member performs rubbing for cleaning in each embodiment. For example, as in the embodiment shown in FIG. 14, recording head 1' may be arranged to move in the direction indicated by arrow B, which is rubbed off slidably by first cleaning member 2*a*' and second cleaning member 2*b*'. Alternatively, while the structure in each of the embodiments is so arranged that the discharging port formation face is rubbed off slidably by moving the recording head, this may also be arranged to move the cleaning members to rub off the discharging port formation face slidably. Further, as in the embodiment shown in FIG. 15, if may be possible to arrange each pair of first and second cleaning members 2*a*, 2*b*, 2*a*' and 2*b*' as shown.

Then, in each of the embodiments, while the descriptions have been made of the structure wherein discharging ports 1*a* are concaved from cap contacting portion 1*b*, it may also be possible to make them convexed therefrom.

Also, in each of the embodiments, while the structure is so arranged that first cleaning member 2*a* is first in contact with the discharging port formation face, this may also be structured so that second cleaning member 2*b* is first in contact therewith.

Now, since the present invention is structured as has been set forth above, there are the effects thereof given below.

Irrespective of the structual condition that the discharging ports of the recording head are formed on the same plane of the other constituents or not, a perfect cleaning can be effectuated by separating the cleaning functions of the members; a member which functions to clean the discharging port formation portion, and another member which functions to clean the portions other than that portion. Hence, it is possible to improve the reliability of image recording because with this cleaning system, the adhesion of ink and sticking of foreign substances to the discharging port formation face can be prevented to maintain a stable ink discharging condition as well as to avoid the dropping of liquid droplets to adhere to the recording medium.

The present invention demonstrates excellent effects for the ink jet recording heads and apparatuses, particularly for an ink jet head and apparatus to generate flying liquid droplets for recording by utilizing heat energy.

For the typical structure and principle thereof, it is desirable to adopt the fundamental principles disclosed in the specifications of U.S. Pat. Nos. 4,723,129 and 4,740,796, for example. The methods disclosed in those specifications are applicable to both of the so-called on-demand type and continuous type. Particularly in the case of the on-demand type, heat energy is generated by an electrothermal converter, which is arranged in accordance with a sheet or liquid path holding liquid (ink) employed therefor, and at least one driving signal applied to the electrothermal converter generates the recording liquid with a rapid temperature rise which exceeds the nuclear boiling point in response to recording information. As a result, the recording liquid in the vicinity of the thermoactive plane of the recording head is brought to a film boiling; thus consequently forming bubbles in the recording liquid by the driving signals one to one effectively. By the actions effectuated in this process of the growth and contraction of bubbles, the recording liquid is discharged into the atmosphere through the discharging port to form at least one drop. If the driving signals are generated in the form of pulses, the growth and contraction of bubbles are instantaneously performed to enable an appropriate discharging of recording liquid, which is particularly fine in response time. The pulse driving method should preferably be adopted, and driving signals in pulse form such as disclosed in the specifications of U.S. Pat. Nos. 4,463,359 and 4,345,262 are suitably adoptable. In this respect, it is possible to perform a finer recording by adopting the conditions disclosed in the specification of U.S. Pat. No. 4,313,124 concerning the invention on the temperature rise ratio of the above-mentioned thermoactive plane.

Regarding the structure of the recording head, those disclosed in the specifications of U.S. Pat. Nos. 4,558,333 and 4,459,600 wherein the thermoactive part is arranged in a curbing area, are included in the present invention in addition to the structure (linear liquid path or right-angled liquid path) formed by combining discharging ports, liquid path, and electrothermal converter as disclosed in each of the above-mentioned specifications. Besides, the present invention is effectively applicable to the structures based on those disclosed in Japanese Laid-Open Patent Application 59-123670, wherein the slit common to a plurality of electrothermal converters is utilized as a discharging port of the electrothermal converter, and in Japanese Laid-Open Patent Application 59-138461, wherein the opening to absorb the pressure waves generated by heat energy is arranged for the discharging port.

Further, regarding the full-line type recording head having the length corresponding to the width of the maximum recording medium which the recording apparatus can accept for recording, there are structures to satisfy the required length by combining or a plurality of recording heads or by forming them integrally as one recording head. Both are effectively applicable, and the present invention can be employed to enhance those effects in either case.

Furthermore, the present invention is effectively applicable to the chip-type recording head which is freely replaceable and enables electrical connection with the main body of the apparatus or ink supply from the main body thereof when the head is installed therein.

It is also desirable to add recording means, preparatory auxiliary means, etc. which are provided as constituents of a recording apparatus of the present invention because with these constituents, the effects of the apparatus become more stable. Specifically, these constituents are capping means for the recording head, cleaning means, compressing or sucking means, electrothermal converter or heating element aside therefrom, or preparatory heating means formed by combining them. It is also effective for a stable recording to perform a preparatory discharging mode which is the preparatory execution of discharging aside from the recording itself.

Further, the present invention is particularly effective for an apparatus provided with a recording mode of a complex coloring having different colors or at least one of full colors by mixing colors with the recording heads formed integrally into one body or combining plural heads, not to mention the recording mode of a main color such as black only.

In the embodiments of the present invention set forth above. The descriptions have been made with ink as fluid. However, it is common practice to use ink which is solidified at room temperature or less and to perform a temperature control so that ink becomes soft or liquidized at room temperature or the viscosity of ink is maintained in the range of stable discharging in the above-mentioned ink jet by adjusting the temperature of ink itself within a range of 30° C. or more but 70° C. or less. Therefore, there is no problem encountered if only the ink to be used is fluid at the time of applying the recording signals currently in use. In addition, by preventing ink from becoming fluid from solid by positively using the temperature-rise caused by heat energy as energy for changing such states or by using the ink which is solidified when left as it is for the purpose of preventing ink dehydration, or an ink capable of being discharged as liquid ink when heat energy is applied in accordance with the recording signals or an ink which begins to be solidified when reaching the recording medium, etc., it is possible to apply to the present invention an ink having a property that it is only liquidized by heat energy. In such a case, as disclosed in Japanese Laid-Open Patent Applications 54-56847 or 60-71260, it may be possible to hold ink in a fluid or solid state in the concavities or through holes of a porous sheet which faces the electrothermal converter. According to the present invention, an apparatus wherein the above-mentioned film boiling method is employed is the most effective for each of the above-mentioned kinds of ink.

Furthermore, as a mode of the recording apparatus provided with a recording mechanism using an ink jet recording head according to the present invention, a copying apparatus combined with reader, etc. and a facsimile apparatus having transmitting and receiving functions may be adopted in addition to the image output terminal of information processing apparatus such as a computer, etc.

Figure 16:
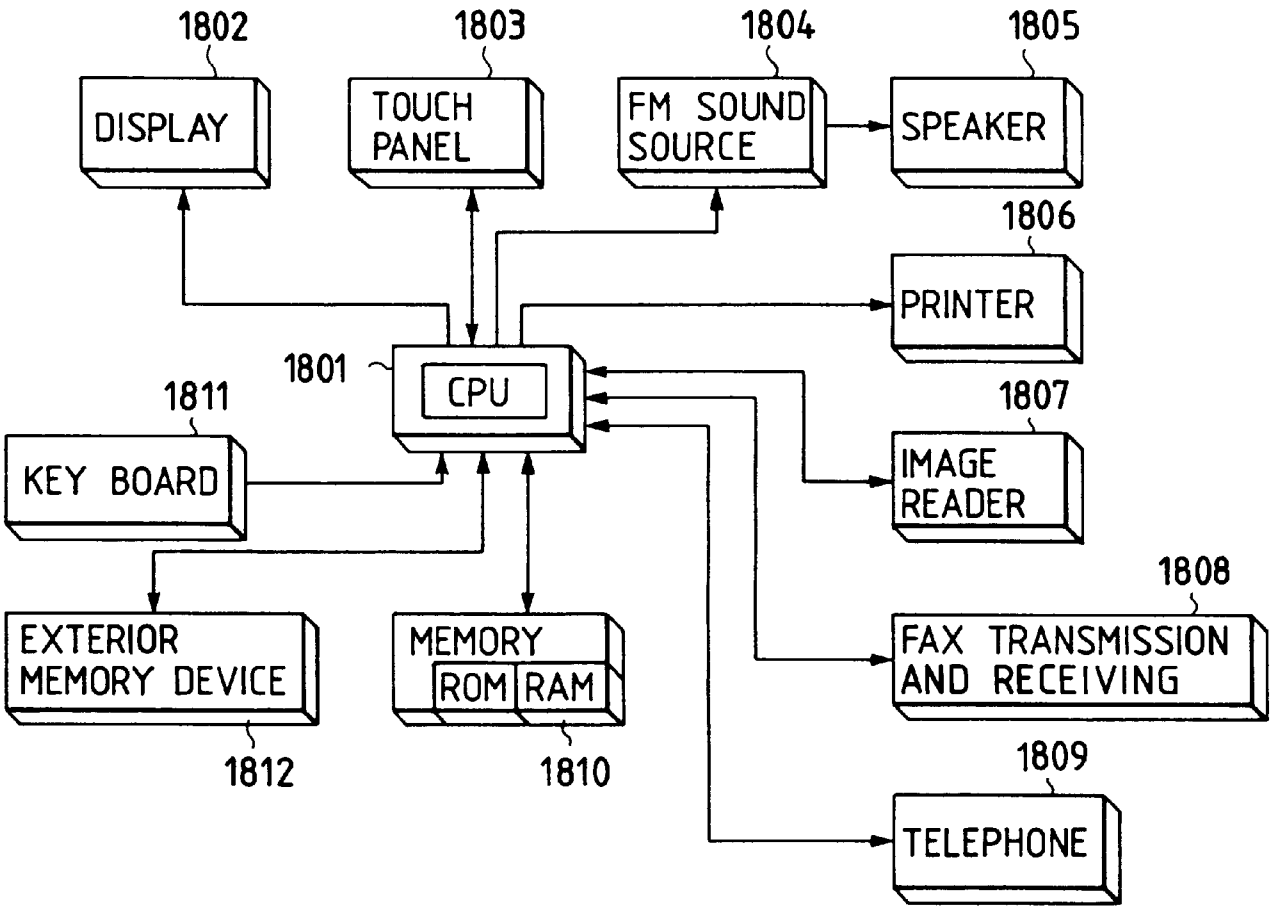
FIG. 16 is a block diagram showing the configuration in which the apparatus is applicable to an information processing system according to the present invention.

FIG. 16 is a block diagram schematically showing the structure of a recording apparatus according to the present invention, which is applied to an information processing apparatus having functions of a word processor, a personal computer, a facsimile apparatus, and a copying apparatus.

In FIG. 16, controlling unit 1801 performs the control of the entire system, comprising CPU such as microprocessor, etc. and various I/O ports to output control signals and data signals to each unit or input control signals and data signals from each unit to execute the required control. Display unit 1802 displays on its display screen various menu, documentary information, image data read by image reader 1807, etc. Touch panel 1803, which is transparent and pressure sensitive, is arranged on display unit 1802 to enable items and coordinate positions to be inputted into display unit 1802 by depressing the surface of the panel by a finger, etc.

FM (Frequency Modulation) sound source 1804 stores musical information produced by music editor, etc. in memory 1810 and peripheral storage unit 1812 as digital data, and reads such data from the memory, etc. for FM modulation. Electrical signals from the FM sound source 1804 are converted into audible sound by speaker unit 1805. Printing unit 1806, to which the recording apparatus of the present invention is applied, is an output terminal for a word processor, a personal computer, and a copying apparatus.

Image recording unit 1807 reads an original photoelectrically for input and is arranged to read various originals in addition to those for facsimile and copying. Facsimile (FAX) transmitting and receiving unit 1808 having interface functions with the outside to transmit the original data read by image reader unit 1807 for facsimile and receiving facsimile signals transmitted for recording. Telephone unit 1809 has various telephoning functions such as an ordinary telephone function, answering phone function, etc.

Memory unit 1810 includes ROM storing the system program, manager program, and other application programs, and character fonts, dictionary, etc., and RAM storing application program, documentary information, video, etc. loaded from the peripheral storage unit 1812.

Keyboard unit 1811 is used to input documentary information, various commands, etc.

Peripheral storage unit 1812 employs floppy discs, hard discs, etc. as storing media. In this peripheral storage unit 1812, documentary information, musical and voice information, user's application program, etc. are stored.

Figure 17:
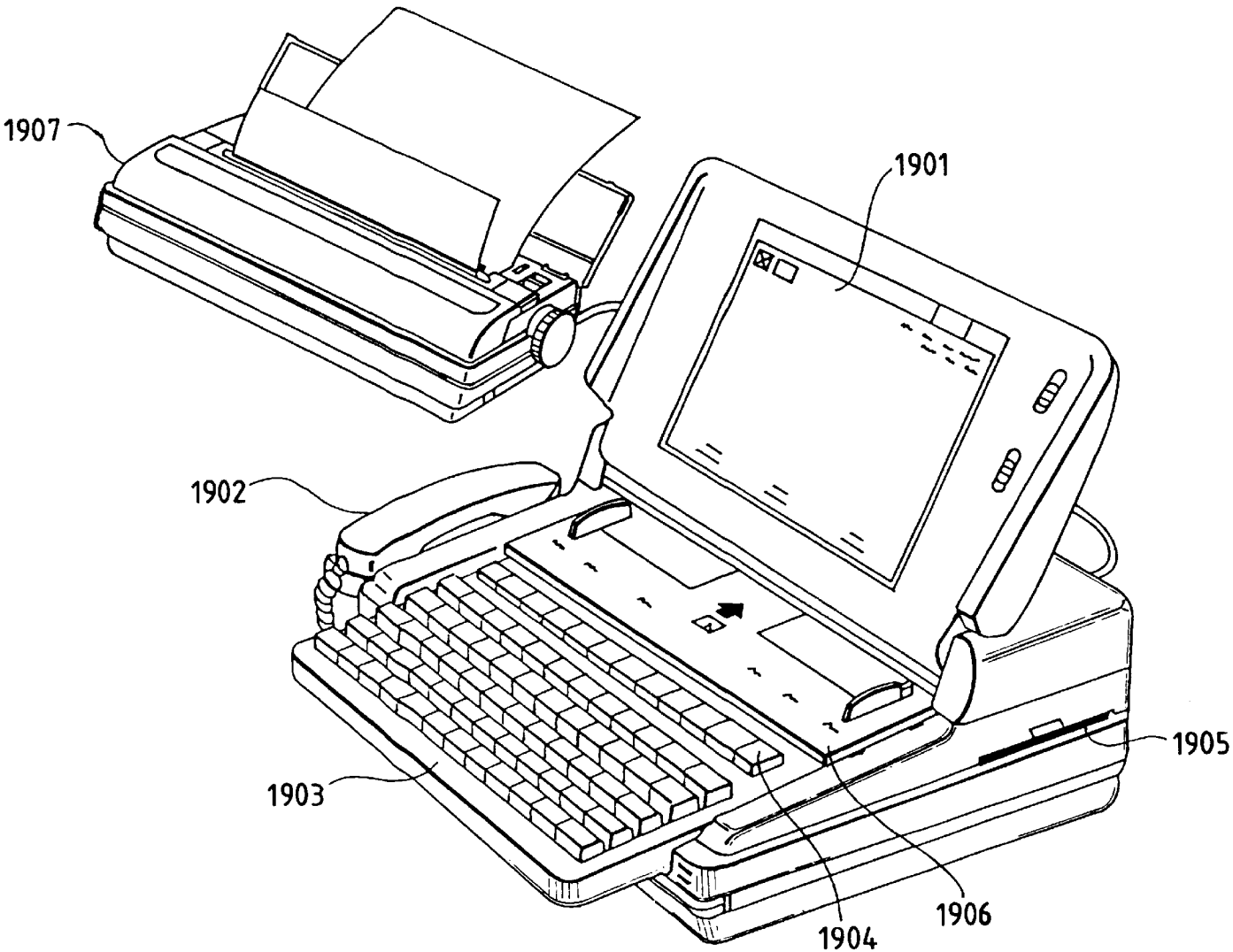
FIG. 17 is a view showing the external appearance of an information processing system.

FIG. 17 is a view showing the typical external appearance of an information processing apparatus shown in FIG. 16.

In FIG. 17, a reference numeral 1901 designates a flat panel display utilizing liquid crystal, etc. to display various menu, graphic information, etc. On this display 1901, touch panel 1803 is installed. By depressing the surface of this touch panel 1803 with a finger, etc., it is possible to input coordinates and specific items. Handset 1902 is used when the apparatus functions as a telephone set. Keyboard 1903 is detachably connected to the main body through a cord, thereby inputting various documentary information and various data. Also, in this Keyboard 1904, various functional keys 1904, etc. are arranged. A reference numeral 1905 designates an inlet for a floppy disc for the peripheral storage unit 1812.

Paper stacking unit 1906 stacks originals to be read by image reader unit 1807 and exhausts originals read from the rear side of the apparatus. Also, when receiving facsimile signals, etc., recording is performed by ink jet printer 1907.

In this respect, while the above-mentioned display unit 1802 can be a CRT, it is preferable to employ a flat panel such as liquid crystal, etc. utilizing ferroelectric liquid crystal, which enables the apparatus to be made smaller, thinner and lighter.

In the case of the above-mentioned information processing apparatus functioning as a personal computer or a word processor, various kinds of inputted information from keyboard unit 1811 are processed by controlling unit 1801 in accordance with a given program and output to printing unit 1806 as received image signals.

In the case of the apparatus functioning as a receiver for a facsimile apparatus, facsimile information inputted from FAX transmitting and receiving unit 1808 through a communication line is processed for receiving in accordance with a given program and output to printing unit 1806 as image signals received.

Also, in the case of the apparatus functioning as a copying apparatus, originals are read by image reader unit 1807, and the original data thus read are output to printing unit 1806 as copying image through controlling unit 1801. In this respect, in the case of the apparatus functioning as a transmitter for a facsimile apparatus, the original data read by image reader unit 1807 is processed for transmitting by controlling unit 1801 in accordance with a given program and transmitted to the communication line through FAX receiving and transmitting unit 1808.

Figure 18:
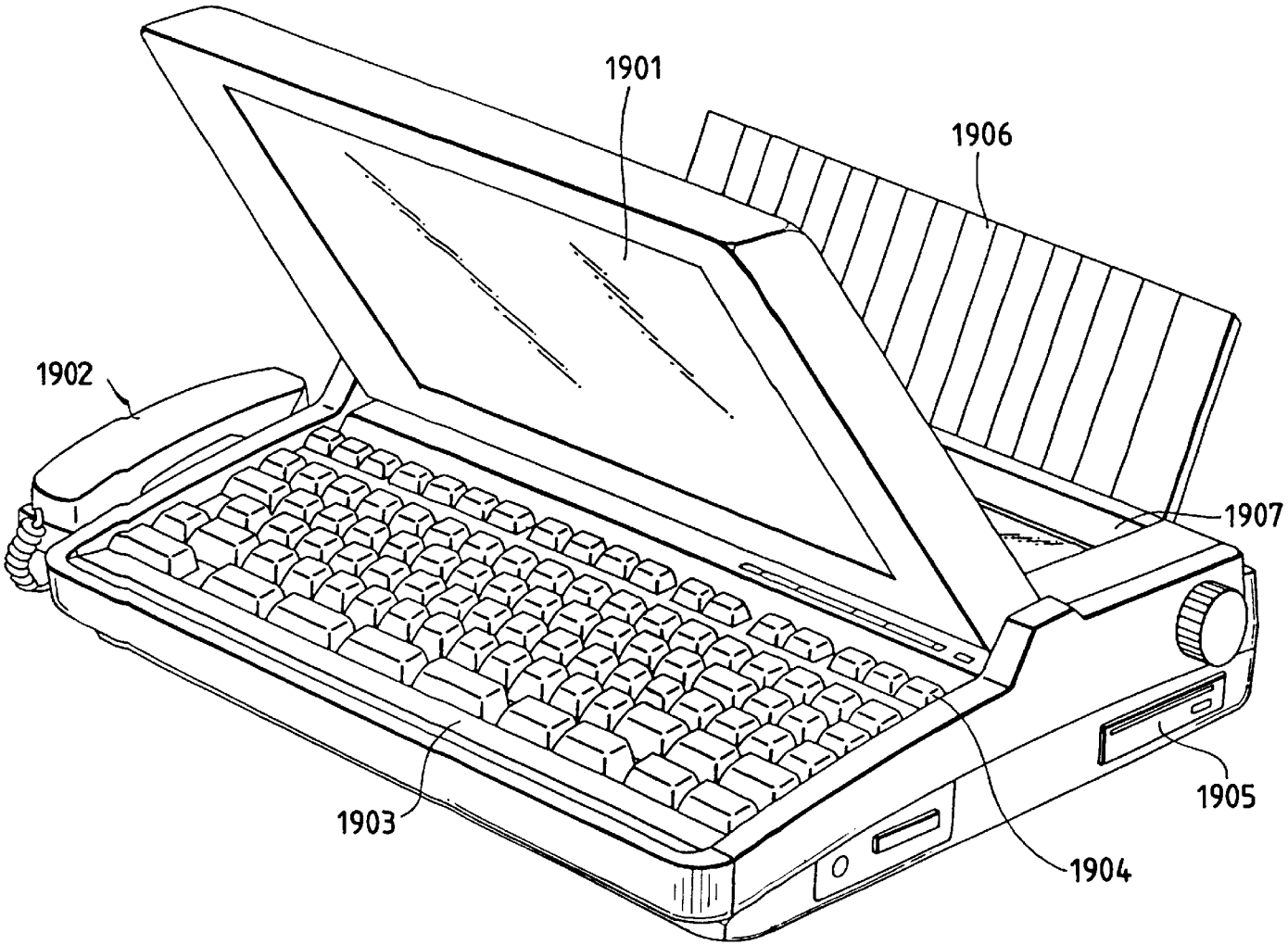
FIG. 18 is a view showing the external appearance of another information processing system.

Also, as shown in FIG. 18, the above-mentioned information processing apparatus may also be constructed with an ink jet printer built-in as an integrated body. In this case, it becomes possible to enhance the portability. In FIG. 18, those constituents having the same functions as in FIG. 17 are referenced by the same numbers.

Applying the recording apparatus of the present invention to the multi-functional information processing apparatus set forth above enables the functions of the above-mentioned processing apparatus to be further improved because with this recording apparatus, a high-quality image can be recorded at a high speed with low noise.

What is claimed is:

1. An ink jet recording apparatus for use with ink jet recording means for discharging ink onto a recording medium, the recording means including an ink jet recording head with a first surface defining at least one discharge port and a second surface surrounding the first surface, said apparatus comprising:

a carriage member for movably supporting and mounting the recording means;

a cleaning device for cleaning the ink jet recording head, said cleaning device being formed of an elastic plate-like member having a first cleaning member for primarily cleaning the first surface and a second cleaning member for primarily cleaning the second surface;

displacing means for displacing said cleaning device between a cleaning position at which said cleaning device cleans the ink jet recording head and a non-cleaning position at which said cleaning device is remote from the ink jet recording head; and a control member for controlling relative movement between said carriage member and said displacing means to control cleaning of the ink jet recording head by said cleaning device, wherein said cleaning device is formed such that said first cleaning member contacts the ink jet recording head before said second cleaning member during relative movement between said cleaning device and the ink jet recording head in a cleaning direction and said second cleaning member is divided into two portions each facing the cleaning direction, with each one of said two portions disposed on each lateral side of said first cleaning member with respect to the cleaning direction.

2. An jet apparatus according to claim 1, wherein said two portions of said second cleaning member are angled outwardly with respect to the cleaning direction to direct substances wiped from the ink jet recording head toward respective outer edges of said two portions.

3. An ink jet recording apparatus according to claim 1, further comprising a cap member for covering said ink jet recording head, wherein said second cleaning member cleans the second surface of substances left by said cap member.

4. An ink jet recording apparatus according to claim 1, wherein the recording means is provided with an electrothermal converting element for generating heat energy and discharges ink by changing a state of the ink with the heat energy.

5. A cleaning mechanism for maintaining and recovering ink discharged from an ink jet recording head, said mechanism comprising:

a first cleaning member for primarily cleaning a first portion of the recording head on which an ink discharge port is formed; and a second cleaning member for cleaning a second portion of the recording head which does not include an ink discharge port, wherein said first and second cleaning members are formed from an elastic plate-like member which is moved in a cleaning direction to wipe the recording head, said first cleaning member is disposed forwardly of said second cleaning member so it contacts the ink jet recording head before said second cleaning member and said second cleaning member is divided into two portions each facing the cleaning direction, with each one of said two portions disposed on each lateral side of said first cleaning member with respect to the cleaning direction.

6. A mechanism according to claim 5, wherein said two portions of said second cleaning member are angled outwardly with respect to the cleaning direction to direct substances wiped from the ink jet recording head toward respective outer edges of said two portions.

7. A cleaning mechanism according to claim 5, further comprising a cap member for covering the ink jet recording head, wherein said second cleaning member cleans the second portion of the recording head of substances left by said cap member.

8. A cleaning mechanism according to claim 5, wherein the recording head is provided with an electrothermal converting element for generating heat energy and discharges ink by changing a state of the ink with the heat energy.

9. An ink jet recording apparatus for use with ink jet recording means for discharging ink onto a recording medium, said recording means including an ink jet recording head with a first surface defining at least one discharge port and a second surface surrounding said first surface, said apparatus comprising:

a carriage member for movably supporting and mounting said recording means;

a cleaning device for cleaning the ink jet recording head, said cleaning device being formed of an elastic plate-like member having a first cleaning member for primarily cleaning the first surface and a second cleaning member for primarily cleaning the second surface;

displacing means for displacing said cleaning device between a cleaning position at which said cleaning device cleans the ink jet recording head and a non-cleaning position at which said cleaning device is remote from the ink jet recording head; and a control member for controlling relative movement between said carriage member and said displacing means to control cleaning of the ink jet recording head by said cleaning device, wherein said cleaning device is formed such that said first cleaning member contacts the ink jet recording head before said second cleaning member during relative movement between said cleaning device and the ink jet recording head in a cleaning direction and said first cleaning member does not contact portions of the second surface laterally spaced from said first cleaning member with respect to the cleaning direction.

10. An ink jet apparatus according to claim 9, wherein the recording means is provided with an electrothermal converting element for generating heat energy and discharges ink by changing a state of the ink with the heat energy.

11. An ink jet recording apparatus according to claim 10, further comprising a cap member for covering said ink jet recording head, wherein said second cleaning member cleans the second surface of substances left by said cap member.

12. An ink jet apparatus according to claim 9, wherein a width l of said first cleaning member satisfies a relationship of $f<l<e$, where f is a width of the discharging port, and e is a width of the first surface.

13. An ink jet recording apparatus according to claim 9, wherein an area cleaned by said first cleaning member overlaps with an area cleaned by said second cleaning member at lateral sides of said first cleaning member with respect to the cleaning direction.

14. An ink jet recording apparatus according claim 9, further comprising a cap member for covering said ink jet recording head, wherein said second cleaning member cleans the second surface of substances left by said cap member.

15. A cleaning mechanism for maintaining and recovering ink discharged from an ink jet recording head, said mechanism comprising:

a first cleaning member for primarily cleaning a first portion of the recording head on which an ink discharge port is formed; and a second cleaning member for cleaning a second portion of the recording head which does not include an ink discharge port, wherein said first and second cleaning members are formed from an elastic plate-like member which is moved in a cleaning direction to wipe the recording head, said first cleaning member is disposed forwardly of said second cleaning member so it contacts the ink jet recording head before said second cleaning member and said first cleaning member does not contact portions of the second portion of the recording head laterally spaced from said first cleaning member with respect to the cleaning direction.

16. A cleaning mechanism according to claim 15, wherein an area cleaned by said first cleaning member overlaps with an area cleaned by said second cleaning member at lateral sides of said first cleaning member with respect to the cleaning direction.

17. A cleaning mechanism according to claim 15, further comprising a cap member for covering the ink jet recording head, wherein said second cleaning member cleans the second portion of the recording head of substances left by said cap member.

18. A cleaning mechanism according to claim 15, wherein the recording head is provided with an electrothermal converting element for generating heat energy and discharges ink by changing a state of the ink with the heat energy.

19. A cleaning mechanism for cleaning an ink discharge surface of a recording head, said mechanism comprising:

a first cleaning member for cleaning an area of said recording head where an array of discharge ports of said recording head is arranged, the area cleaned by said first cleaning member being characterized as a first area; and a second cleaning member for cleaning another area of said recording head, the area cleaned by said second cleaning member being characterized as a second area, said second area being substantially separate from said first area and only partly overlapping therewith;

wherein said first and second cleaning members are so arranged that a contact timing of said first cleaning member on said first area is different from a contact timing of said second cleaning member on said second area with respect to a relative moving direction of said recording head, and said first area overlaps with said second area at lateral sides of said first cleaning member.

20. A cleaning mechanism according to claim 19, wherein the recording head is provided with an electrothermal converting element for generating heat energy and discharges ink by changing a state of the ink with the heat energy.

21. A cleaning mechanism comprising:

a cleaning blade for cleaning a surface of a recording head, said surface having a recessed area where discharge ports for discharging ink in a plurality of arrays of discharge ports are provided and an enclosing area enclosing said recessed area, wherein said cleaning blade is divided with a cutout located on said blade to correspond with a border portion of said surface between said recessed area and said enclosing area with respect to a relative moving direction of said recording head to said cleaning blade, and said cleaning blade comprises a first cleaning member and a second cleaning member separated by said cutout, and an area cleaned by said first cleaning member overlaps with an area cleaned by said second cleaning member at lateral sides of said first cleaning member.

22. A cleaning mechanism according to claim 21, wherein the recording head is provided with an electrothermal converting element for generating heat energy and discharges ink by changing a state of the ink with the heat energy.

23. A cleaning mechanism for maintaining and recovering ink discharged from an ink jet recording head, the mechanism comprising:

a first cleaning member for primarily cleaning a first portion of said recording head on which an ink discharge port is formed; and a second cleaning member for cleaning a second portion of said recording head which does not include an ink discharge port, wherein said first and said second cleaning members are formed from an elastic plate-like member which is moved in a cleaning direction to wipe said recording head, and an area cleaned by said first cleaning member overlaps with an area cleaned by said second cleaning member at lateral sides of said first cleaning member.

24. A cleaning mechanism according to claim 23, wherein the recording head is provided with an electrothermal converting element for generating heat energy and discharges ink by changing a state of the ink with the heat energy.

25. An ink jet apparatus comprising:

a carriage for carrying an ink jet head with a discharge port for discharging ink therefrom;

a first cleaning member for cleaning an area of said ink jet head where said discharge port is provided, the area cleaned by said first cleaning member being characterized as a first area, said first cleaning member being disposed at a first position; and a second cleaning member for cleaning another area of said ink jet head, the area cleaned by said second cleaning member being characterized as a second area, said second area being substantially separate from said first area and only partly overlapping therewith, said second cleaning member being disposed at a second position separated from said first position with respect to a carrying direction of said carriage, wherein said first area and said second area partly overlap with each other with respect to the carrying direction of said carriage.

26. An ink jet apparatus according to claim 25, wherein a portion of said first area of said ink jet head which includes said discharge port is recessed with respect to said second area.

27. An ink jet apparatus according to claim 25, wherein the ink jet head is provided with an electrothermal converting element for generating heat energy and discharges ink by changing a state of the ink with the heat energy.

28. An ink jet apparatus comprising:

a carriage for carrying an ink jet head with a discharge port for discharging ink therefrom; and a cleaning mechanism for cleaning an ink discharge surface of the ink jet head, said mechanism having a first cleaning member for cleaning an area of said ink jet head where the discharge port is arranged, the area cleaned by said first cleaning member being characterized as a first area, and a second cleaning member for cleaning another area of said ink jet head, the area cleaned by said second cleaning member being characterized as a second area, said second area being substantially separate from said first area and only partly overlapping therewith, wherein said first and second cleaning members are so arranged that a contact timing of said first cleaning member on said first area is different from a contact timing of said second cleaning member on said second area with respect to a relative moving direction of the ink jet head, and said first area overlaps with said second area at lateral sides of said first cleaning member.

29. An ink jet apparatus according to claim 28, wherein the ink jet head is provided with an electrothermal converting element for generating heat energy and discharges ink by changing a state of the ink with the heat energy.

30. An ink jet apparatus comprising:

a carriage for carrying an ink jet head with a discharge port for discharging ink therefrom; and a cleaning mechanism having a cleaning blade for cleaning a surface of the ink jet head, said surface having a recessed area where the discharge port is provided and an enclosing area enclosing said recessed area, wherein said cleaning blade is divided with a cutout located on said blade to correspond with a border portion of said surface between said recessed area and said enclosing area with respect to a relative moving direction of the ink jet head to said cleaning blade, and said cleaning blade comprises a first cleaning member and a second cleaning member separated by said cutout, and an area cleaned by said first cleaning member overlaps with an area cleaned by said second cleaning member at lateral sides of said first cleaning member.

31. An ink jet apparatus according to claim 30, wherein the ink jet head is provided with an electrothermal converting element for generating heat energy and discharges ink by changing a state of the ink with the heat energy.

32. An ink jet apparatus comprising:

a carriage for carrying an ink jet head with a discharge port for discharging ink therefrom; and a cleaning mechanism for maintaining and recovering the ink discharged from the ink jet head, the mechanism having a first cleaning member for primarily cleaning a first portion of said ink jet head on which the discharge port is formed and a second cleaning member for cleaning a second portion of the ink jet head which does not include the discharge port, wherein said first and said second cleaning members are formed from an elastic plate-like member which is moved in a cleaning direction to wipe the ink jet head, and an area cleaned by said first cleaning member overlaps with an area cleaned by said second cleaning member at lateral sides of said first cleaning member.

33. An ink jet apparatus according to claim 32, wherein the ink jet head is provided with an electrothermal converting element for generating heat energy and discharges ink by changing a state of the ink with the heat energy.

34. A cleaning mechanism for cleaning a recording face of a recording head in a cleaning direction, the recording face including an ink discharge surface defined by a plurality of discharge ports and a capping surface surrounding the ink discharge surface, said cleaning mechanism comprising:

a first cleaning member sized to clean the ink discharge surface and, at least in a direction across the cleaning direction, not to clean the capping surface; and a second cleaning member, in close adjacency to said first cleaning member, wherein in a plane substantially parallel with said recording face and in a direction across the cleaning direction, said second cleaning member is larger than said first cleaning member, and wherein said second cleaning member is sized to clean the capping surface.

35. A cleaning mechanism according to claim 34, wherein said ink discharge surface is recessed with respect to said capping surface.

36. A cleaning mechanism according to claim 34, wherein said first cleaning member and said second cleaning member are formed from respective first and second elastic plate-like members, and wherein said first and second cleaning members and said recording head are relatively movable in the cleaning direction.

37. A cleaning mechanism according to claim 36, wherein said first elastic plate-like member is in contact with said second elastic plate-like member.

38. A cleaning mechanism according to claim 36, wherein a thickness of said second elastic plate-like member is greater than a thickness of said first elastic plate-like member.

39. A cleaning mechanism according to claim 36, wherein the cleaning direction extends in a direction corresponding to the plurality of discharge ports.

40. A cleaning mechanism according to claim 36, wherein the cleaning direction extends in a direction across the direction of the plurality of discharge ports.

41. A cleaning mechanism according to claim 36, wherein the following relationships are satisfied:

$$f<l<e$$

$$W_1 \geqq w,$$

wherein f corresponds to a dimension of the plurality of discharge ports, f corresponds to a width of the first elastic plate-like member, e corresponds to a width of the ink discharge area, $W_1$ corresponds to a width of the capping area, and w corresponds to a width of said second elastic plate-like member.

42. An ink jet apparatus for cleaning a recording face of a recording head in a cleaning direction, the recording face including an ink discharge surface defined by a plurality of discharge ports and a capping surface surrounding the ink discharge surface, said ink jet apparatus comprising:

a first cleaning member sized to clean the ink discharge surface and, at least in a direction across the cleaning direction, not to clean the capping surface; and a second cleaning member, in close adjacency to said first cleaning member, wherein in a plane substantially parallel with said recording face and in a direction across the cleaning direction, said second cleaning member is larger than said first cleaning member, and wherein said second cleaning member is sized to clean the capping surface.

43. An ink jet apparatus according to claim 42, wherein each discharge port of said recording head is provided with an electrothermal converting element for generating heat energy and discharging ink by changing a state of the ink with the heat energy.

44. A cleaning mechanism according to claim 42, wherein said ink discharge surface is recessed with respect to said capping surface.

* * * * *

UNITED STATES PATENT AND TRADEMARK OFFICE

CERTIFICATE OF CORRECTION

PATENT NO. : 6,213,582 B1
DATED : April 10, 2001
INVENTOR(S) : Haruo Uchida et al.

It is certified that error appears in the above-identified patent and that said Letters Patent is hereby corrected as shown below:

Column 2,
Line 8, change "The" to -- However, the --; and
Line 30, change "these" to -- they --.

Column 3,
Line 32, change "clean" to -- cleans --.

Column 4,
Line 37, change "is" to -- are --.

Column 8,
Line 55, change "or a" to -- a --.

Column 10,
Line 42, change "Keyboard" to -- keyboard --.

Column 12,
Line 23, change "mechanism" to -- cleaning mechanism --.

Column 16,
Line 58, change "f" to -- l --.

Column 18,
Line 6, change "A cleaning mechanism" to -- An ink jet apparatus --.

Signed and Sealed this

Sixteenth Day of April, 2002

*Attest:*

*Attesting Officer*

JAMES E. ROGAN
*Director of the United States Patent and Trademark Office*